US007877211B2

(12) United States Patent
Follini et al.

(10) Patent No.: US 7,877,211 B2
(45) Date of Patent: Jan. 25, 2011

(54) DOWNLINK BASED ON PUMP NOISE

(75) Inventors: Jean-Marc Follini, Houston, TX (US); Remi Hutin, New Ulm, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 607 days.

(21) Appl. No.: 11/771,075

(22) Filed: Jun. 29, 2007

(65) Prior Publication Data

US 2008/0068210 A1 Mar. 20, 2008

Related U.S. Application Data

(60) Provisional application No. 60/826,023, filed on Sep. 18, 2006.

(51) Int. Cl.
*G01V 1/40* (2006.01)

(52) U.S. Cl. ..... 702/9

(58) Field of Classification Search ..... 702/2, 702/6, 9, 14, 17, 75–77, 79, 104, 106, 138, 702/141, 159, 182, 183, 185, 188, 189, 191; 367/30, 83; 73/152.22

See application file for complete search history.

(56) References Cited

U.S. PATENT DOCUMENTS

| | | | | |
|---|---|---|---|---|
| 4,114,721 | A | 9/1978 | Glenn, Jr. | |
| 4,171,185 | A | 10/1979 | Duke et al. | |
| 4,849,945 | A * | 7/1989 | Widrow | 367/30 |
| 5,154,078 | A * | 10/1992 | Codazzi | 73/152.22 |
| 5,182,730 | A * | 1/1993 | Scherbatskoy | 367/83 |
| 5,390,153 | A * | 2/1995 | Scherbatskoy | 367/83 |
| 6,237,404 | B1 | 5/2001 | Schlumberger | |
| 6,681,633 | B2 | 1/2004 | Halliburton | |
| 7,028,543 | B2 | 4/2006 | Lamb | |
| 7,251,566 | B2 | 7/2007 | Schlumberger | |

* cited by examiner

*Primary Examiner*—Mohamed Charioui
(74) *Attorney, Agent, or Firm*—Dave R. Hofman

(57) ABSTRACT

A method for determining a drilling event includes measuring a first signal from a sensor over a first selected time interval, measuring a second signal from the sensor over a second time interval, determining if a noise is reduced in the second signal.

5 Claims, 3 Drawing Sheets

DOWNLINK BASED ON PUMP NOISE

CROSS-REFERENCES

The present application claims priority of U.S. Provisional Patent Application Ser. No. 60/826,023 filed on Sep. 18, 2006. The Provisional Application is incorporated by reference in its entirety.

BACKGROUND OF THE INVENTION

This invention relates to determining when drilling has been stopped during a drilling operation. More specifically, the invention relates to measuring noise downhole to determine when the mud pumps have been turned off.

Drilling for oil and other deposits within the Earth involves the drilling of wellbores into the Earth. To create the wellbore, a downhole drilling tool is suspended from a drilling rig and advanced into the earth via a drill string. During the drilling operation, it is desirable know the position and orientation of the bottom hole assembly and the drill bit. Typically, these measurements are made during brief pauses of the drilling operations. Such a pause may be for the purpose of adding a section of drill pipe to the drill string or for making a measurement or taking a sample of the formation and the fluids it contains. In some cases, a pause in drilling operations serves more than one purpose.

During such a pause, the drill bit is not being rotated and the mud pumps are often shut down. This is often the best time to make measurements related to the direction and inclination of the drill bit, called "taking a stationary survey."

SUMMARY OF THE INVENTION

In one aspect, a method for determining a drilling event includes measuring a first signal from a sensor over a first selected time interval, measuring a second signal from the sensor over a second time interval, and determining if a noise is reduced in the second signal.

In another aspect, a method for determining a drilling event includes measuring a first signal from a sensor over a first time interval, transforming the first signal into a frequency domain, determining if a mud pump is operating based on a power signal at an operating frequency of the mud pump.

In another aspect, a downhole tool includes at least one of a pressure sensor and a shock sensor, a electronics operatively coupled to the at least one sensor, wherein the electronics is configured to determine when a noise portion of a sensor signal is reduced.

Other aspects and advantages of the invention will be apparent from the following description and the appended claims.

DETAILED DESCRIPTION

In some examples, the present invention may be used to detect a flow or a no flow condition in the borehole with a very simple apparatus that includes a single pressure sensor. The pressure sensor may measure the hydraulic noise level and make a determination about the whether the mud pumps are on or off.

Figure 1:
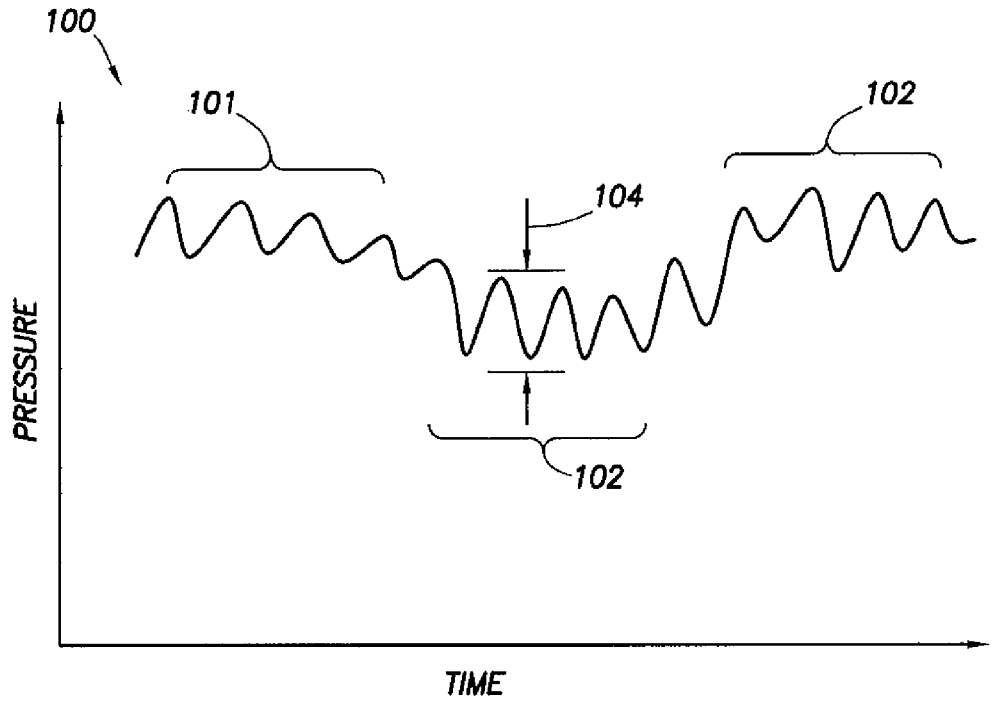
FIG. 1 shows a graph of pressure versus time, in accordance with one embodiment of the invention.

The method is based on the fact that the level hydraulic noise and the fluid pressure inside the drill string or in the annulus is usually reduced when mud circulation off. For example, FIG. 1 shows a graph of a pressure signal 100 over time. In a first region 101, the pressure and the noise are both high. In a second region 102, the pressure is reduced but the noise is still relatively high. In a third region 103, the pressure and the noise are both relatively high. The amplitude of the noise is shown at 104.

This situation may be caused when drilling is stopped and the drill bit is moved off bottom, but the pumps are still on. That would cause the fluid pressure to drop, but the noise of the mud pumps is still present. In general, the drilling process is stopped before the mud pumps are turned off.

In one example, a pressure signal maybe acquired at a selected sampling rate over a fixed element of time (i.e., a sliding acquisition window of 10 seconds) and the noise level of the signal is computed and recorded.

Figure 2:
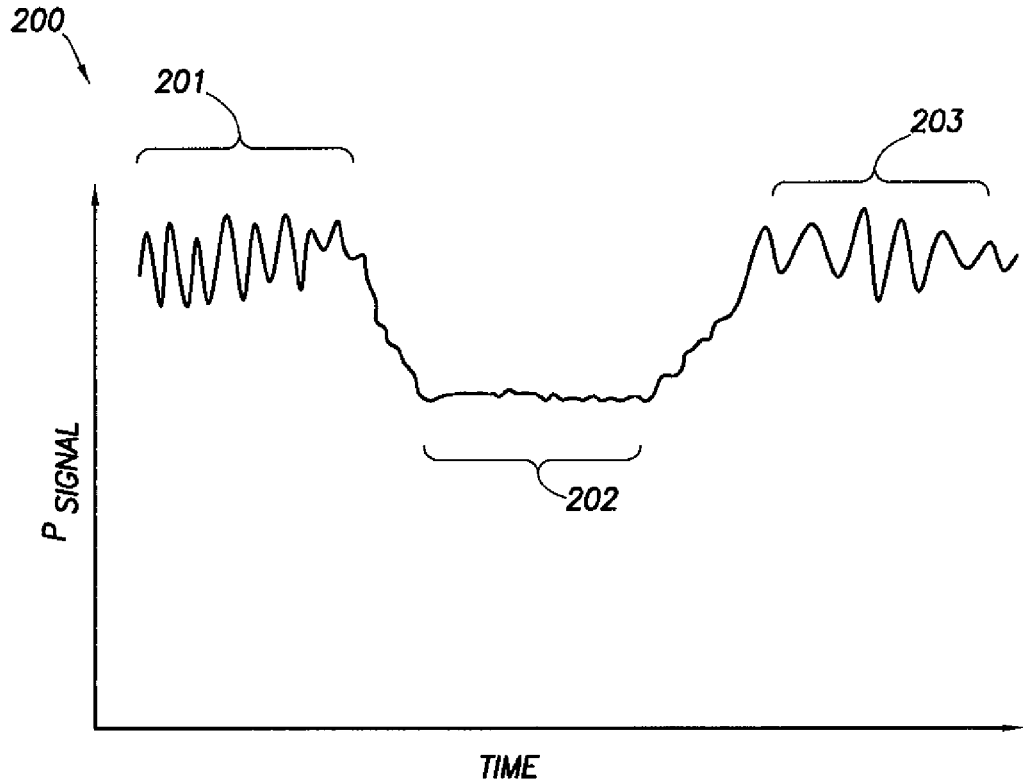
FIG. 2 shows a graph of pressure versus time, in accordance with one embodiment of the invention.

FIG. 2 shows a graph of a pressure signal 200 over time. In the example shown in FIG. 2, a first region 201 and a third region 203 show relatively high pressure and noise. Between the first 201 and third 203 regions, a second period 202 is shown with relatively low pressure and noise. The relatively low pressure and noise in the second region 202 may indicate that drilling has stopped and the mud pumps have been shut off. The relatively high pressure and noise in the third region may indicate that mud flow and drilling have resumed.

Figure 3A:
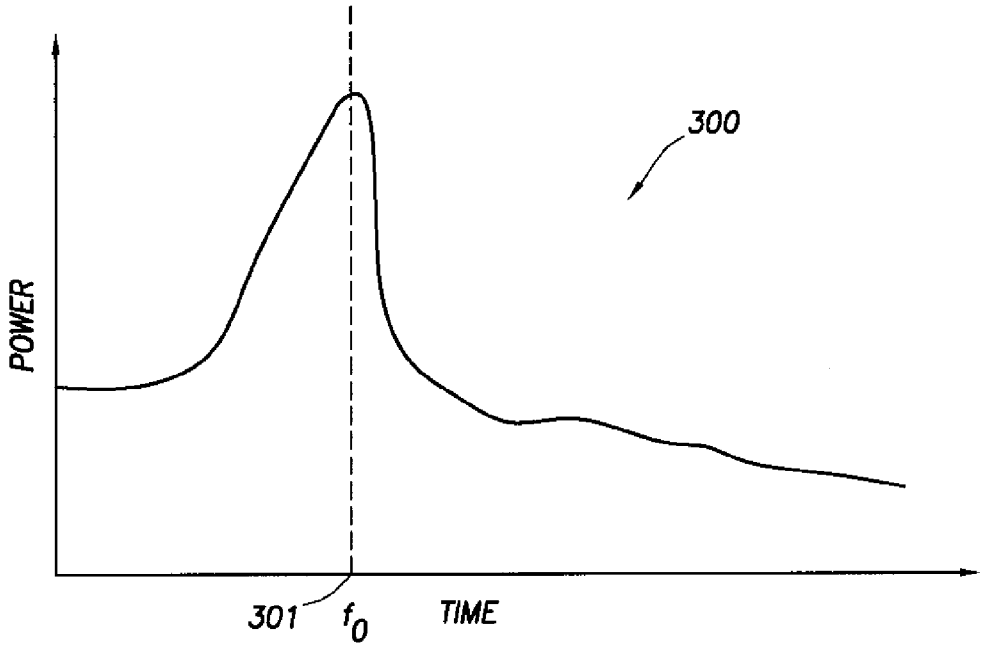
FIG. 3A shows a graph of power versus frequency of a pressure signal, in accordance with one embodiment of the invention.
Figure 3B:
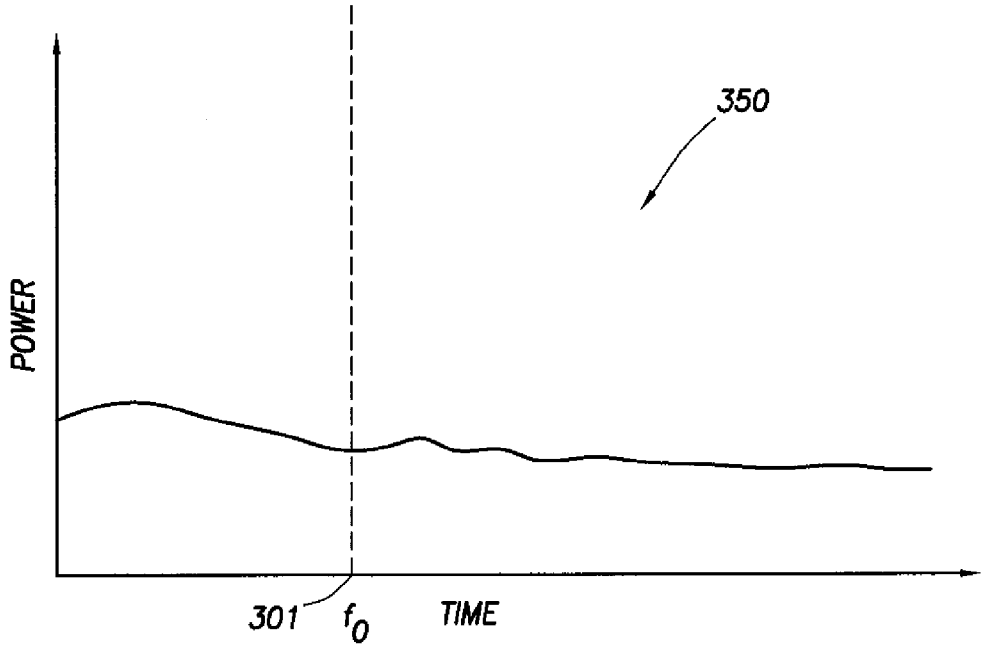
FIG. 3B shows a graph of power versus frequency of a pressure signal, in accordance with one embodiment of the invention.

In another example, as illustrated in FIG. 3A, spectral analysis of pressure data, such as a Fast Fourier Transform, may be used to analyze the frequencies included in the hydraulic signal. As shown in FIG. 3B, the power signal 300 is plotted as a function of time. A spike in the power of the pressure signal may be observed at the frequency of the mud pumps 301. Typically, mud pumps are operated between 1 Hz and 10 Hz. As shown in FIG. 3B, the power signal 350 does not include a spike at the frequency of the mud pumps 301. The mud pumps may be off when the power spike at the mud pump frequency 301 is no longer present.

Figure 4:
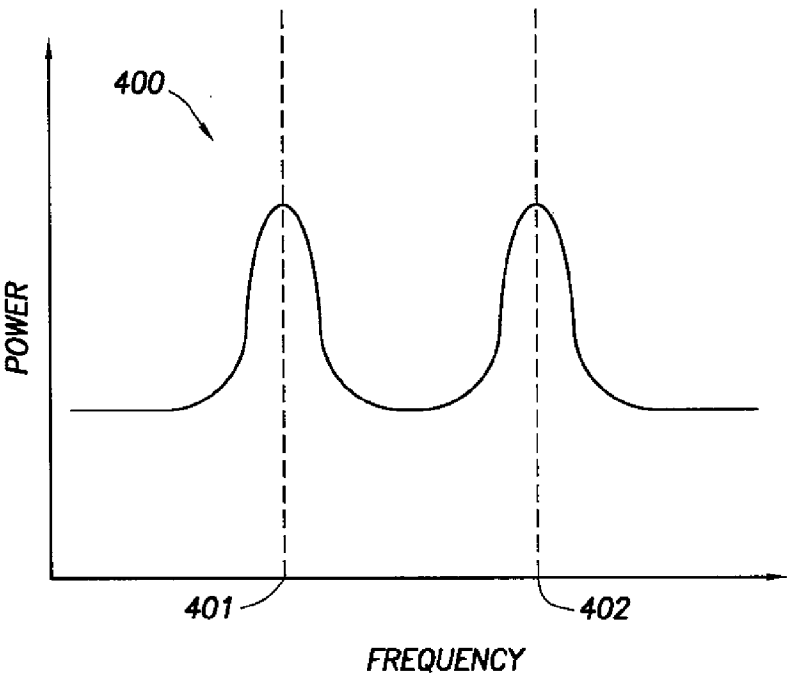
FIG. 4 shows a graph of power versus frequency of a pressure signal, in accordance with one embodiment of the invention.

In another example, a drilling may include a mud siren at the surface. The frequency of the mud siren may be selected so that it does not overlap with the noise generated by the mud pumps. As shown in FIG. 4, the power 400 is plotted as a function of frequency. There exists a spike at the frequency of the mud pumps 401 and a spike at the frequency of the siren 402.

In one example, the downhole tool may determine that the mud pumps have stopped running based on the lack of a power spike at both the mud pump frequency 401 and the siren frequency 402. In another example, the downhole tool may determine that the mud pumps have stopped running based on the lack of a power spike at the siren frequency 402. In another example, during drilling operations, the mud siren may be used to transmit downlink signals that may be detected by the pressure sensor and demodulated by the downhole tool.

Figure 5:
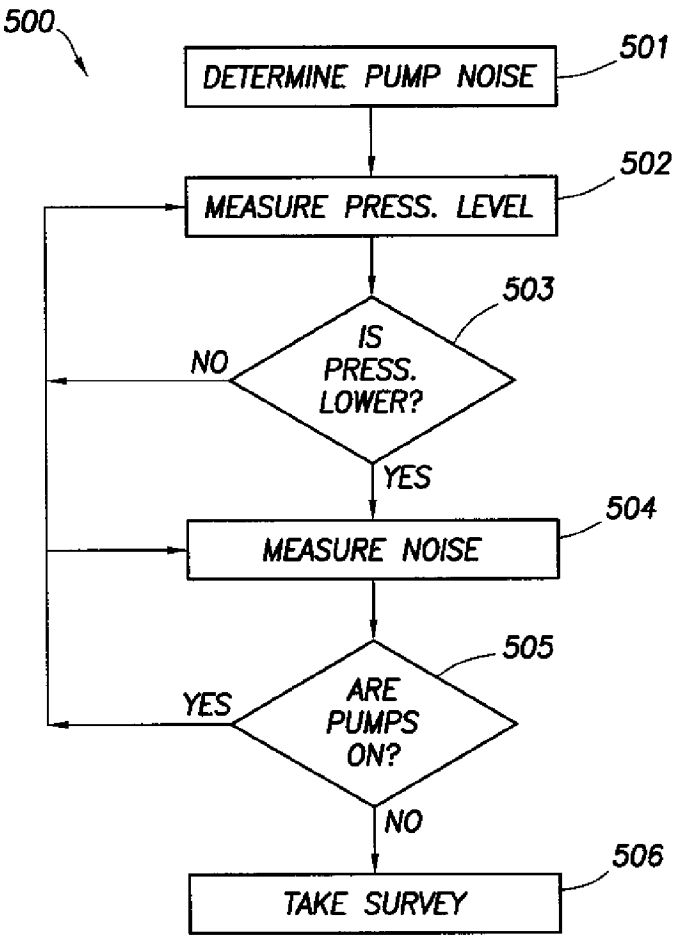
FIG. 5 shows one example of a method in accordance with the invention.

FIG. 5 shows one example of a method 500 for determining when drilling has stopped. The method may include determining the amplitude of the noise in the pressure signal that is present when the mud pumps are on and mud flow is circulating, at 501. In an alternative example, a calibration phase may be implemented to determine the level of noise that should be expected in a no-flow condition.

Next, the method may include measuring the pressure level, at 502. In one example, the pressure must go down before a measurement of the noise is used to determine if the mud pumps are on or off. Such an implementation may conserve downhole processing power by limiting the windows over which the pressure noise is analyzed. At 503 it is determined if the pressure is lower than expected in a drilling operation. If the pressure is not reduced, the method would revert to measuring the pressure level. If the pressure is lower, then the method may continue to determine the noise.

The method may next include measuring the pressure noise, at 504. Based on the noise level, a decision may be made, at 505, as to whether the mud pumps are on or off. If the mud pumps are on, the downhole tool may continue to monitor the noise and the pressure. If it is determined that the mud pumps are off, in one example, the method may include taking a survey of the drill bit direction and inclination, at 506. In another example, the method may include taking a sample of the formation or of the formation fluids. In another example, the method may include resetting the telemetry process once drilling has resumed.

In another example, the determination of whether the mud pumps are off is made by analyzing the power in the pressure noise as a function of frequency. A drop in the power level at the frequency of the mud pumps may indicate that the pumps are off. In another example, a drop in power at the frequency of an up-hole mud siren may be an indication that the mud pumps are off.

In addition to pressure measurements, the principles of the present invention may be applied to other downhole measurements to determine when drilling has stopped. For example, a typical bottom hole assembly may include a shock sensor. It may be determined that drilling has stopped when the noise level on the shock measurements is reduced. In another example, it may be determined that drilling has stopped based on a reduction in noise from a vibration sensor, as well as magnetometers and accelerometers positioned within the bottom hole assembly.

Advantageously, one or more of the disclosed embodiments may be implemented on a downhole tool. Such tools include an electromagnetic telemetry tool, a mud pulse telemetry tool, a direction and inclination measurement tool, and a formation evaluation tool. Embodiments of the invention may be implemented on other downhole tools, as well.

While the invention has been described with respect to a limited number of embodiments, those skilled in the art, having benefit of this disclosure, will appreciate that other embodiments can be devised which do not depart from the scope of the invention as disclosed herein. For example, the elastomeric members may be used in any downhole operation involving rotatable elements. Accordingly, the scope of the invention should be limited only by the attached claims.

What is claimed is:

1. A method for determining a drilling event, comprising:

measuring a first signal from a sensor over a first selected time interval;

measuring a second signal from the sensor over a second time interval;

determining a frequency of noise in the first signal;

determining a power of the noise in the first signal and the second signal; and performing an action by a downhole tool if the power of the noise is reduced in the second signal.

2. The method of claim 1, wherein the action performed by the downhole tool comprises initiating a survey when the noise is reduced.

3. The method of claim 1, wherein the action performed by the downhole tool comprises initiating a sampling operation when the noise is reduced.

4. The method of claim 1, wherein the action performed by the downhole tool comprises resetting a telemetry process.

5. The method of claim 1, wherein the sensor is at least one selected from a pressure sensor, a shock sensor, a magnetometer, an accelerometer, a vibrations sensor, and a gyroscope.

* * * * *